US008638283B2

(12) United States Patent
Kota et al.

(10) Patent No.: US 8,638,283 B2
(45) Date of Patent: Jan. 28, 2014

(54) TIMING CONTROLLER, IMAGE DISPLAY DEVICE, TIMING SIGNAL GENERATING METHOD, AND IMAGE DISPLAY CONTROL METHOD

(75) Inventors: Atsushi Kota, Kawasaki (JP); Tsuyoshi Ichiraku, Kawasaki (JP); Noriyuki Takagi, Shinagawa-ku (JP)

(73) Assignee: NLT Technologies, Ltd., Kanagawa (JP)

( * ) Notice: Subject to any disclaimer, the term of this patent is extended or adjusted under 35 U.S.C. 154(b) by 656 days.

(21) Appl. No.: 12/783,106

(22) Filed: May 19, 2010

(65) Prior Publication Data

US 2010/0295842 A1 Nov. 25, 2010

(30) Foreign Application Priority Data

May 20, 2009 (JP) ..... 2009-122348

(51) Int. Cl.
*G09G 3/36* (2006.01)

(52) U.S. Cl.
USPC ..... 345/98

(58) Field of Classification Search
USPC ..... 345/98–100
See application file for complete search history.

(56) References Cited

U.S. PATENT DOCUMENTS 8,022,919 B2 * 9/2011 Kwon et al. ..... 345/100
2007/0152944 A1 7/2007 Kwon et al.

FOREIGN PATENT DOCUMENTS

| | | | |
|---|---|---|---|
| CN | 1485806 | A | 3/2004 |
| CN | 1727964 | A | 2/2006 |
| CN | 1917025 | A | 2/2007 |
| JP | 09-160526 | A | 6/1997 |
| JP | 2002-207452 | A | 7/2002 |
| JP | 2007-183542 | A | 7/2007 |

OTHER PUBLICATIONS

Chinese Office Action issued Jul. 24, 2013 in corresponding Chinese Patent Application No. 201010181313.3.

* cited by examiner

*Primary Examiner* — Waseem Moorad
(74) *Attorney, Agent, or Firm* — Sughrue Mion, PLLC

(57) ABSTRACT

A timing controller is provided which is capable of achieving normal image display at a time of reverse scanning in upward and downward directions and right and left directions. In an image display device having a plurality of scanning line driving ICs (Integrated Circuits), a valid line counting section counts a count of valid driving lines based on a DE (Data Enable) signal and DCK (Dot Clock) signal. A cascade signal counting section counts up a total count of outputs from a count of VCK (Vertical Clock) signals including a VSP (Vertical Start Pulse) 2 output signal up to a VSP1 cascade outputting signal VSP1. A calculating section calculates an excessive output of a scanning line driving IC from a difference between the count of valid driving lines and the total count of outputs. A VSP generating section generates and outputs a VSP2 signal at a time shifted from a reference VSP generating time by time being equivalent to the excessive output calculated by the calculating section thus enabling reverse scanning.

16 Claims, 14 Drawing Sheets

TIMING CONTROLLER, IMAGE DISPLAY DEVICE, TIMING SIGNAL GENERATING METHOD, AND IMAGE DISPLAY CONTROL METHOD

INCORPORATION BY REFERENCE

This application is based upon and claims the benefit of priority from Japanese Patent Application No. 2009-122348, filed on May 20, 2009, the disclosure of which is incorporated herein in its entirely by reference.

BACKGROUND OF THE INVENTION

1. Field of the Invention

The present invention relates to a timing controller, an image display device using the same, a timing signal generating method, and an image display control method, and more particularly to the timing controller in which a method for generating a start pulse to be used for a driving of a scanning line and a signal line, the image display device using the same, the timing signal generating method, and the image display control method.

2. Description of the Related Art

Conventionally, an image display device is widely used in various fields. There are different types of usage modes of the image display device. For example, when the image display device is disposed in an upward location for working, it is necessary, structurally, that the image display device can be inverted up and down. In some cases, the image display device has to be turned upside down so that visibility of a viewer is improved. Also, it is preferable that a video image inverted right and left is displayed on a screen in an image display device provided at a barbershop, a hair salon or a like, such that a customer can see, without feeling abnormal, a video image through a front mirror, that is, a video image in a front mirror. To implement these functions, conventionally, there is a display device such as a TV (television), monitor, or the like having a function of inverting a display screen right and left or up and down.

A related display device is known which can perform not only sequential scanning but also reverse scanning in upward and downward directions or in right and left directions in particular. In the related display device described above, a timing controller 210 for the display device as shown in FIG. 10 is used.

The timing controller 210 for the display device includes a VSP generating section 214 to generate a VSP (Vertical Start Pulse) signal at a time designed in advance based on a combination between a count of outputs from a scanning line driving IC (Integrated Circuit) to be determined at a setting terminal and also based on resolution of a display panel to be determined at the setting terminal and a scanning direction, a timing signal generating signal to generate an HSP (Horizontal Start Pulse) signal for a signal line driving IC, a DLP (Data Latch Pulse) signal, a VCK (Vertical Clock) signal for the scanning line driving IC, a VOE (Vertical Output Enable) signal, a POL (Polarity inverting) signal to AC (Alternating Current)-drive a liquid crystal display, and a DCK (Dot Clock) signal, and a video data processing section to process video data to be supplied from the outside.

FIG. 11 shows a related liquid crystal display device 200 constructed by using the above timing controller 210 for a display device. The liquid crystal display device 200 is made up of a timing controller 210 for a display device, a liquid crystal display panel 220, a signal line electrode driving circuit 230, and a scanning line electrode driving circuit 240.

The liquid crystal display panel 220 includes a plurality of scanning electrodes mounted on its substrate at a predetermined interval in a row direction, a plurality of signal line electrodes mounted on its substrate at a predetermined interval in a column direction, a liquid crystal cell being an equivalently capacitive load at an intersection for both the electrodes in a manner opposite and being sandwiched, a common electrode, a TFT (Thin Film Transistor) to drive a corresponding liquid crystal cell, and a capacitor to store electric charges corresponding to data for one vertical synchronizing period.

The signal line electrode driving circuit 230 is made up of one or more HTCPs (Horizontal Tape Carrier Packages) 231 each having a signal line driving IC 232 and having a plural-stage structure in which the signal line driving ICs 232 are serially connected thereto. Each of the signal line driving ICs 232 captures image data with timing when each of the HSP, DLP, POL and DCK signals is outputted from the timing controller 210 for the display device and has a function of converting the image into a corresponding voltage for every pixel of one line to apply the converted voltage to a corresponding pixel electrode of one line through a drain electrode of the TFT (not shown).

The scanning line electrode driving circuit 240 is made up of one or more VTCPs (Vertical Tape Carrier Packages) 241 each having a scanning line driving IC 242 to be used for driving scanning lines of the liquid crystal display panel 220. The scanning line driving IC 242, based on the VSP, VOE, and VCK signals to be outputted from the timing controller 210 for the display device, performs an operation to simultaneously control all the scanning line electrodes of the TFT belonging to the line for every line sequentially from above in synchronization with a VCK signal and brings each TFT of the line being now controlled into conduction and applies a gray level voltage to be supplied to the signal line connected, at the time of being conducted, from the signal line driving IC 32 to its output, to the pixel electrode of a corresponding liquid crystal cell.

The scanning line driving IC 242, as shown in FIG. 12, is made up of a shift register section 2421 and a scanning line outputting section 2422. The shift register section 2421 sequentially performs a shifting operation in accordance with the vertical start pulse signals VSP1 and VSP2 for the scanning line driving IC 242 to be supplied from the timing controller 210, clock signal VCK for the scanning line driving IC 242, and a signal of an RL terminal to be set by the shift register determining a scanning direction, at a time of rising of the VCK signal for the scanning line driving IC 242. The scanning line outputting section 2422 performs a shift operation on its signal level from an internal operating level to an outputting level. The scanning line electrode driving circuit 240 sequentially generates a scanning signal by its scanning line driving IC 242 and sequentially applies the generated scanning signal to a corresponding scanning electrode of the liquid crystal display panel 220.

In general, the count of lines for resolution of the liquid crystal display panel 220 is larger than the count of outputs from the scanning line driving IC 242. Therefore, a plurality of scanning line driving ICs 242 is cascade-connected. For example, in a case of XGA (eXtended Graphics Array) resolution, since its resolution is 768 lines, as shown in FIG. 13, three pieces of the scanning line driving ICs 242 providing 256 outputs are used to drive the liquid crystal display panel 220. In this case, in the scanning line driving IC 242, the VSP2 terminal of the scanning line driving IC 242(1) is cascade-connected to the VSP1 terminal of the scanning line driving IC 242(2) and the VSP2 terminal of the scanning line driving IC 242(2) is cascade-connected to the VSP1 terminal of the scanning line driving IC 242(3).

As shown on page 2 and page 3 in Patent Reference 1, at a time of sequential scanning, setting is made so that RL="low" and the VSP2 output signal from the scanning line driving IC 242(1) becomes a VSP1 input signal to the scanning line driving IC 242(2) and a shift operation is performed for driving of scanning lines after 257 lines without timing discontinuation. Moreover, in a similar manner, the VSP2 output signal from the scanning line driving IC 242(2) becomes the VSP1 input signal to the scanning line driving IC 242(3) and a shift operation is performed for driving of scanning lines after 513 lines without timing discontinuation.

Further, at a time of reverse scanning, setting is made so that RL="High" and the VSP2 output signal from the scanning line driving IC 242(3) becomes the VSP2 input signal to the scanning line driving IC 242(2) and a shift operation is performed for driving of scanning lines after 257 lines without timing discontinuation. Moreover, in a similar manner, the VSP2 output signal from the scanning line driving IC 242(2) becomes the VSP1 input signal to the scanning line driving IC 242(1) and a shift operation is performed for driving of scanning lines after 513 lines without timing discontinuation.

On the other hand, in recent years, there is increasing a demand for lowering the price of a liquid crystal display device and, to satisfy this demand, the reduction in costs for component materials is becoming a serious problem. In order to respond to the problem, an effort is being made to give priority to costs for a scanning line driving IC making up one of the component parts. For example, the case of using the scanning line driving IC providing not 256 outputs but low-priced 300 outputs is increasing. For example, when a scanning line electrode driving circuit having its XGA of 768 lines is constructed by using three scanning line driving ICs providing 300 outputs each, if the same connecting method for the scanning line driving ICs is the same as that in FIG. 13, as shown in FIG. 14, the excessive outputs of 132 from the scanning line driving ICs occur.

The 132 extra outputs are not connected to the liquid crystal display panel 220 and, as a result, in ordinary cases, open processing is performed and the 132 extra outputs become dummy outputs. In this case, these excessive outputs do not create problems in the sequential scanning, however, the 132 extra outputs become problems in the reverse scanning in upward and downward directions.

That is, in the reverse scanning in the upward and downward directions, as shown in FIG. 14, the driving for scanning starts sequentially from O300 of the scanning line driving IC 242(3) and the initial 300 excessive outputs are dummy outputs and, therefore, are not connected to the liquid crystal display panel 220. As a result, the 132 outputs are not shown and are abnormally displayed in a state of being deviated by 132 lines in the upward and downward directions, still leaving unsolved technical problems in the above related technology.

Due to shared use of cost-reduced components, shared use of materials or members for the timing controller being one of its components is increasing and one timing controller can respond to a plurality of resolutions and a plurality of numbers of outputs from the scanning line driving IC. However, in the above configuration, at the time of designing the timing controller at the development stage, the excessive outputs from the scanning line driving IC are calculated by combinations of resolution at which an image is displayed by one or more resolution setting terminal and of the count of outputs from the scanning line driving IC to be set by the output number setting terminal of one or more scanning line driving ICs and the timing of the VSP2 signal for the scanning line driving IC at the time of reverse scanning is calculated and designed. However, the designed value has to be embedded as a fixed value by combining various resolutions with the count of outputs from various scanning line driving ICs at the time of developing the timing controller.

For example, when the timing controller is so configured as to correspond to both the resolutions XGA (1024×768) and VGA (640×480) and to the count of outputs from the scanning line driving IC of both 256 channels and 300 channels, if three 256 output drivers are used for the XGA (768 lines) resolution, excessive outputs from the driver are 0, if three 256 output drivers are used for XGA (768 lines) resolution, excessive outputs from the driver are 132, if two 256 output drivers are used for XGA (480 lines) resolution, excessive outputs from the driver are 32, and if two 300 output drivers are used for VGA (480 lines) resolution, excessive outputs from the driver are 120.

It is necessary to control the timing controller so that the VSP signals for the scanning line driving IC at the time of reverse scanning achieved by these combinations are outputted with timing of 0, 132, 32, and 120.

A method is disclosed in Patent Reference 2 in which a difference between the count of scanning lines and the count of scanning channels is calculated and a clock signal containing a dummy clock is generated based on the difference and is then inserted into periods of the VCK.

As described above, when the scanning line electrode driving circuit is constructed at a plural stage in which the scanning line driving ICs are serially connected, if the total count of outputs of each of the entire scanning line driving IC are consistent with the count of lines at predetermined resolution of a liquid crystal display panel, no problems arises in displaying. However, in the liquid crystal display device constructed by using a related timing controller, when an excessive output from the scanning line driving IC occurs, in the reverse operations, as measures to be taken against the occurrence of the excessive output, there is no way but to use the value determined by combining the resolution at the time of designing the timing controller with the count of outputs from the scanning line driving IC. The reason is that the combination of the resolution and the count of outputs from the scanning line driving IC is determined in advance at the time of designing.

That is, when the timing controller is driven in accordance with the combination assumed at the time of designing, if an excessive output from the scanning line driving IC occurs, it is necessary that the assumed resolution and the count of outputs from the scanning line driving IC are set to the value already set at the time of designing and, when other resolution and combination are used, a constant for the signal processing board must be again set on the signal processing board, which causes common designing of the signal processing board to be lacking in flexibility.

Moreover, it is impossible to use a scanning line driving IC other than assumed at the time of development and designing of its original one in a shared manner, which causes a difficulty in shared use of other IC parts or other timing controllers, thus resulting in a hindrance to a reduction in costs.

Since there is a limitation to the count of outer setting terminals used to determine the resolution of a timing controller or to the count of outer terminals used to determine the count of outputs from the scanning line driving IC, it is necessary to select, depending on the development state or technological trends at the time of the development, the corresponding resolution or the count of outputs from the scanning line driving IC and the timing of outputting the VSP2 signal was determined by the combination of each resolution or the count of outputs from the already-existing scanning line driving IC. Therefore, when a reduction of costs and shared use of other products is to be achieved by using a new timing controller, unless the new timing controller is constructed so as to correspond to the count of outputs from the already-existing scanning line driving IC, the new timing controller cannot be used as a device for reducing costs and for shared use.

Further, the problem of this kind can be partially solved by using the method stated in Patent Reference 2. However, the disclosed technology also has a problem. In this disclosed method, display resolution and count of outputs from the scanning line driving IC have to be combined in advance at a time of development of the timing controller. As a result, another problem arises that normal operation is not performed if the combination is made by using a different resolution and a count of a different output from the scanning line driving IC. Furthermore, a complicated circuit for inserting a dummy clock among clocks is required.

SUMMARY OF THE INVENTION

In view of the above, it is an object of the present invention to provide a timing controller to be used for displaying a video image reversely which is capable of overcoming non-coincidence between a count of valid driving lines (related to resolution) of a display panel, such as a liquid crystal display panel and an EL (ElectroLuminescence) display panel, and a total count of outputs from a driving section of the display panel, an image display device using the same, a timing signal generating method, and an image display control method.

According to a first aspect of the present invention, there is provided a timing controller to be used for displaying a reverse video image including:

a difference measuring unit to measure, based on a timing signal to be supplied from an outside for every predetermined period to regulate driving of a display panel and a start pulse signal to be outputted when a display panel driving section drives the display panel, a difference between a count of valid driving lines of the display panel and a total count of outputs from the display panel driving section; and a signal outputting unit to output a start pulse signal in reverse scanning with timing shifted from a reference time for an original start pulse signal in sequential scanning, the shifted timing being determined based on the difference measured by the difference measuring unit.

According to a second aspect of the present invention, there is provided a timing signal generating method to be used for displaying a reverse video image, including:

a process of measuring, based on a timing signal to be supplied from an outside for every predetermined period to regulate driving of a display panel and a start pulse signal to be outputted when a display panel driving section drives the display panel, a difference between a count of valid driving lines of the display panel and a total count of outputs from the display panel driving section; and a process of outputting a start pulse signal in reverse scanning with timing shifted from a reference time for an original start pulse signal in sequential scanning, the shifted timing being determined based on the measured difference.

According to a third aspect of the present invention, there is provided an image display device including: a timing controller to be used for displaying a reverse video image including:

a difference measuring unit to measure, based on a timing signal to be supplied from an outside for every predetermined period to regulate driving of a display panel and a start pulse signal to be outputted when a display panel driving section drives the display panel, a difference between a count of valid driving lines of the display panel and a total count of outputs from the display panel driving section; and a signal outputting unit to output a start pulse signal in reverse scanning with timing shifted from a reference time for an original start pulse signal in sequential scanning, the shifted timing being determined based on the difference measured by the difference measuring unit, wherein the reverse scanning of the display panel is performed in accordance with the start pulse signal to be outputted from the signal outputting unit of the timing controller.

According to a fourth aspect of the present invention, there is provided an image display control method for displaying a reverse video image, using a timing signal generating method including:

a process of measuring, based on a timing signal to be supplied from an outside for every predetermined period to regulate driving of a display panel and a start pulse signal to be outputted when a display panel driving section drives the display panel, a difference between a count of valid driving lines of the display panel and a total count of outputs from the display panel driving section; and a process of outputting a start pulse signal in reverse scanning with timing shifted from a reference time for an original start pulse signal in sequential scanning, the shifted timing being determined based on the measured difference.

With the above configuration, it is made possible to automatically and correctly generate a timing signal to be supplied to a driving section to perform a normal display, at a time of sequential scanning and reverse scanning irrespective of non-coincidence (discrepancy) between resolution (count of valid driving lines) of a portion to be driven such as a liquid crystal display panel and a total count of outputs from a driving section of the liquid crystal display panel. Therefore, normal display is performed even when the combination of the count of valid driving lines and the count of outputs from the driving section are arbitrary.

BRIEF DESCRIPTION OF THE DRAWINGS

The above and other objects, advantages, and features of the present invention will be more apparent from the following description taken in conjunction with the accompanying drawings in which.

DETAILED DESCRIPTION OF THE PREFERRED EMBODIMENTS

Best modes of carrying out the present invention will be described in further detail using various embodiments with reference to the accompanying drawings.

First Exemplary Embodiment

Figure 1:
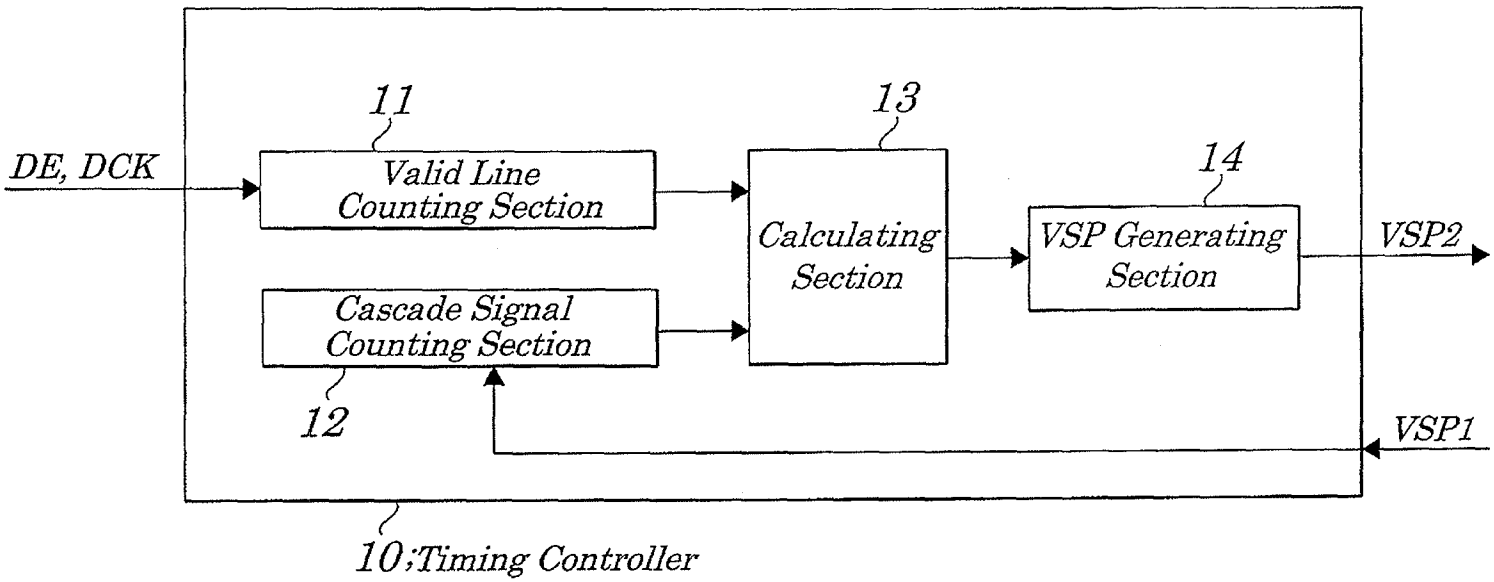
FIG. 1 is a block diagram showing electrical configurations of a timing controller for an image display device according to a first exemplary embodiment of the present invention.
Figure 2:
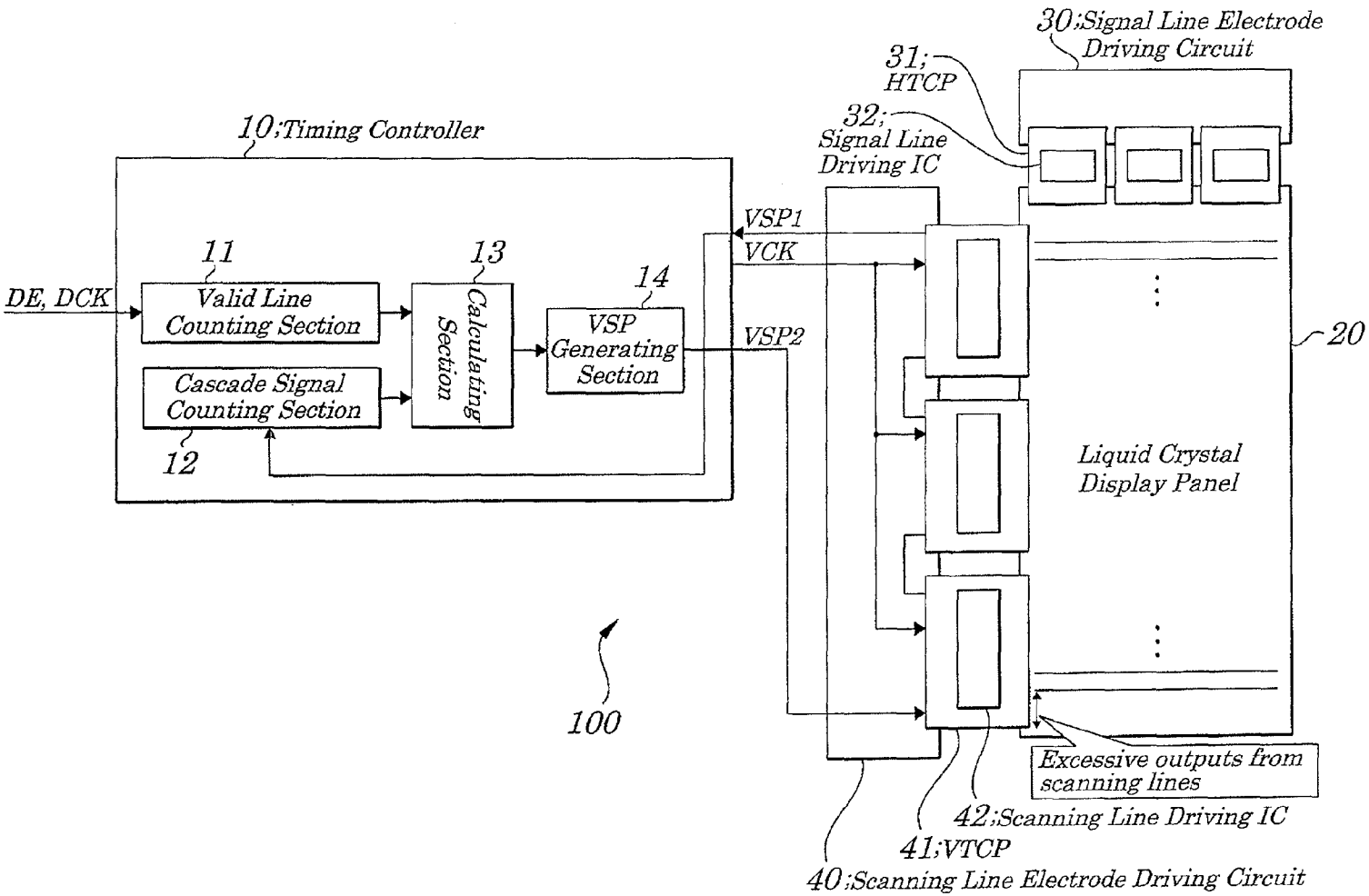
FIG. 2 is a block diagram showing electrical configurations of a liquid crystal display device using the timing controller for the image display device according to the first exemplary embodiment.
Figure 3:
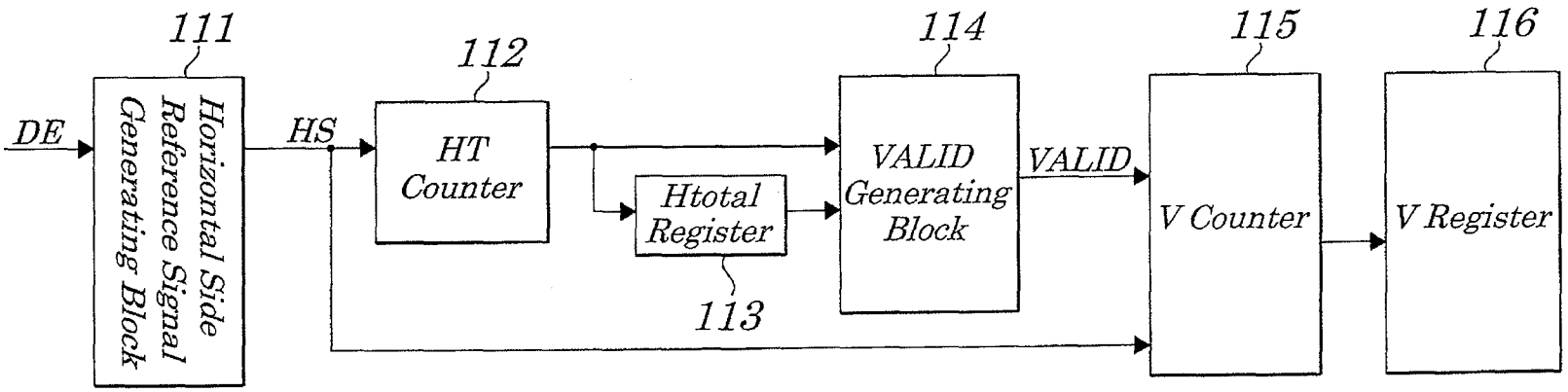
FIG. 3 is a block diagram showing electrical configurations of a valid line counting section of the timing controller for the image display device according to the first exemplary embodiment.
Figure 4:
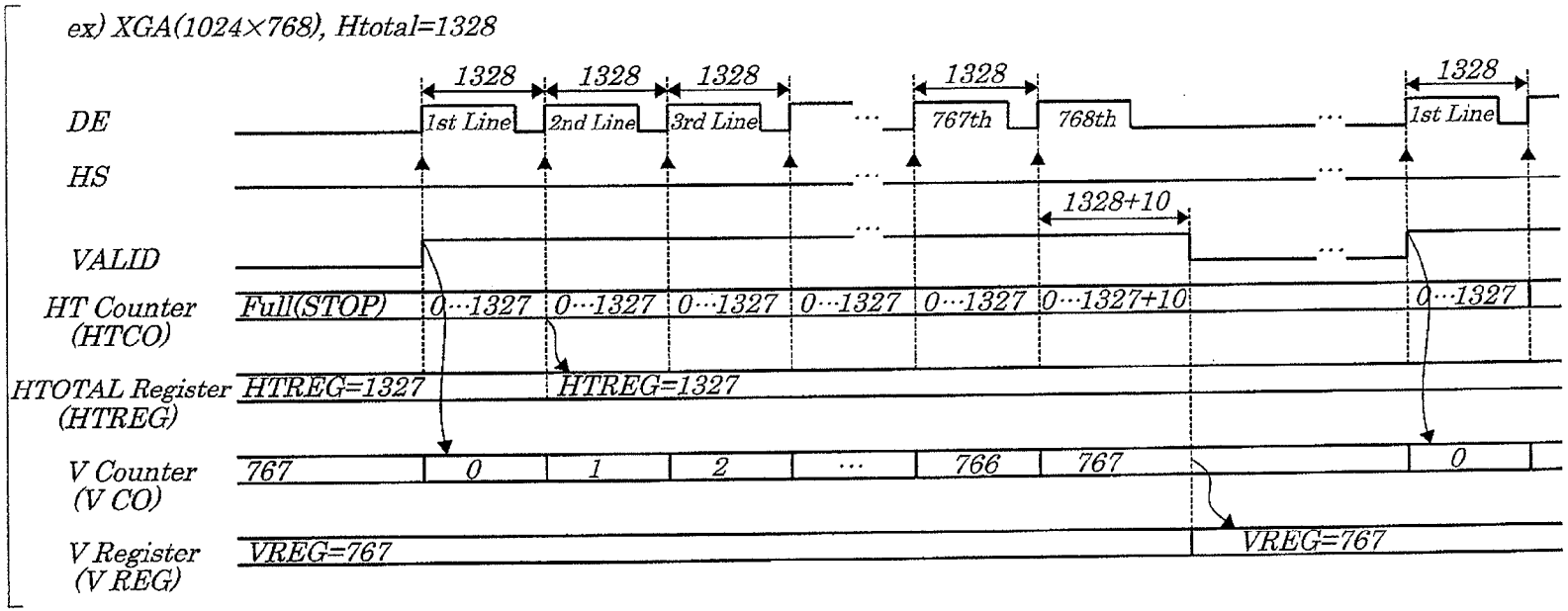
FIG. 4 is a timing chart showing internal signals of the timing controller for the image display device according to the first exemplary embodiment.
Figure 5:
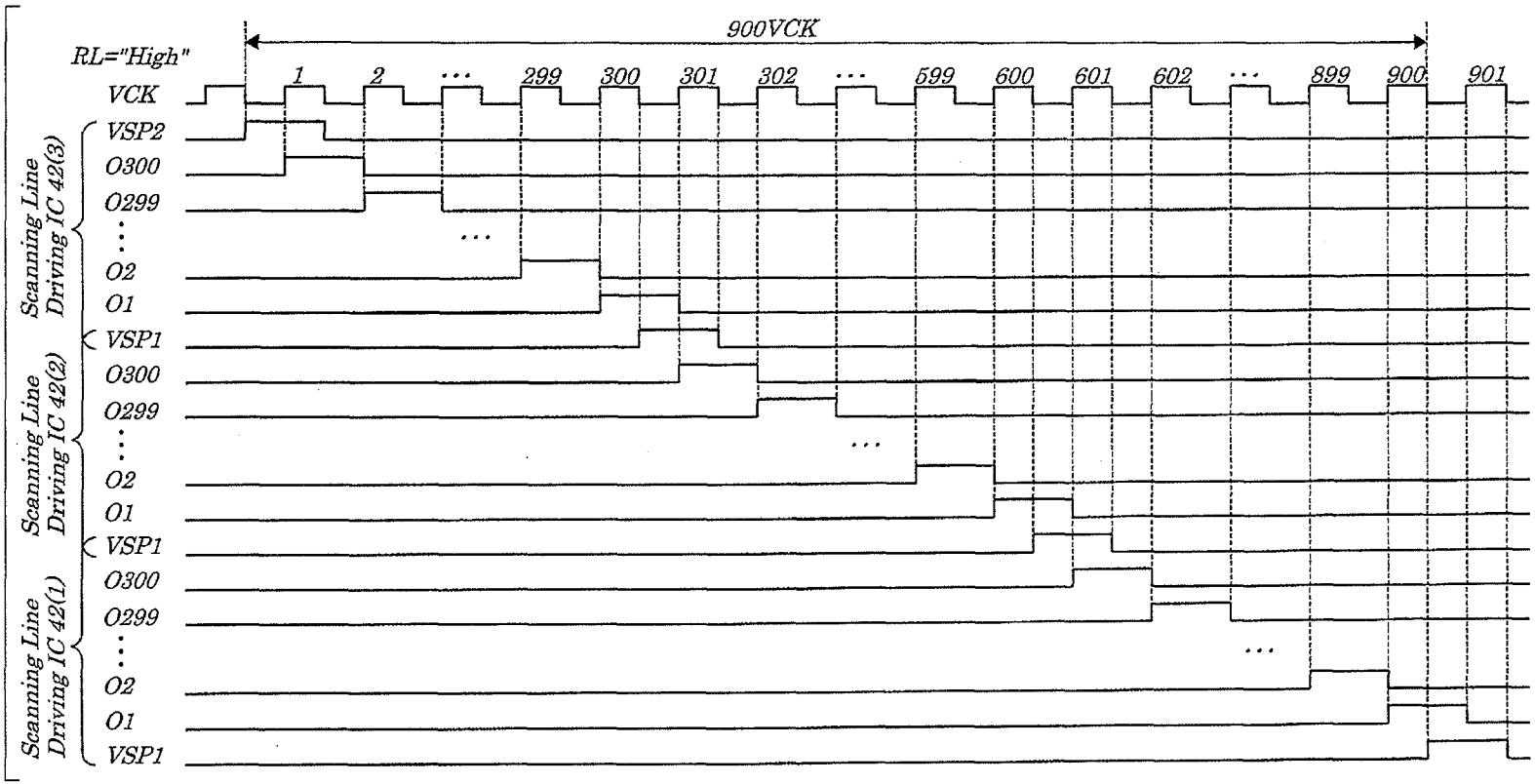
FIG. 5 is timing chart explaining operations of a cascade signal counting section making up the timing controller for the image display device according to the first exemplary embodiment.
Figure 6:
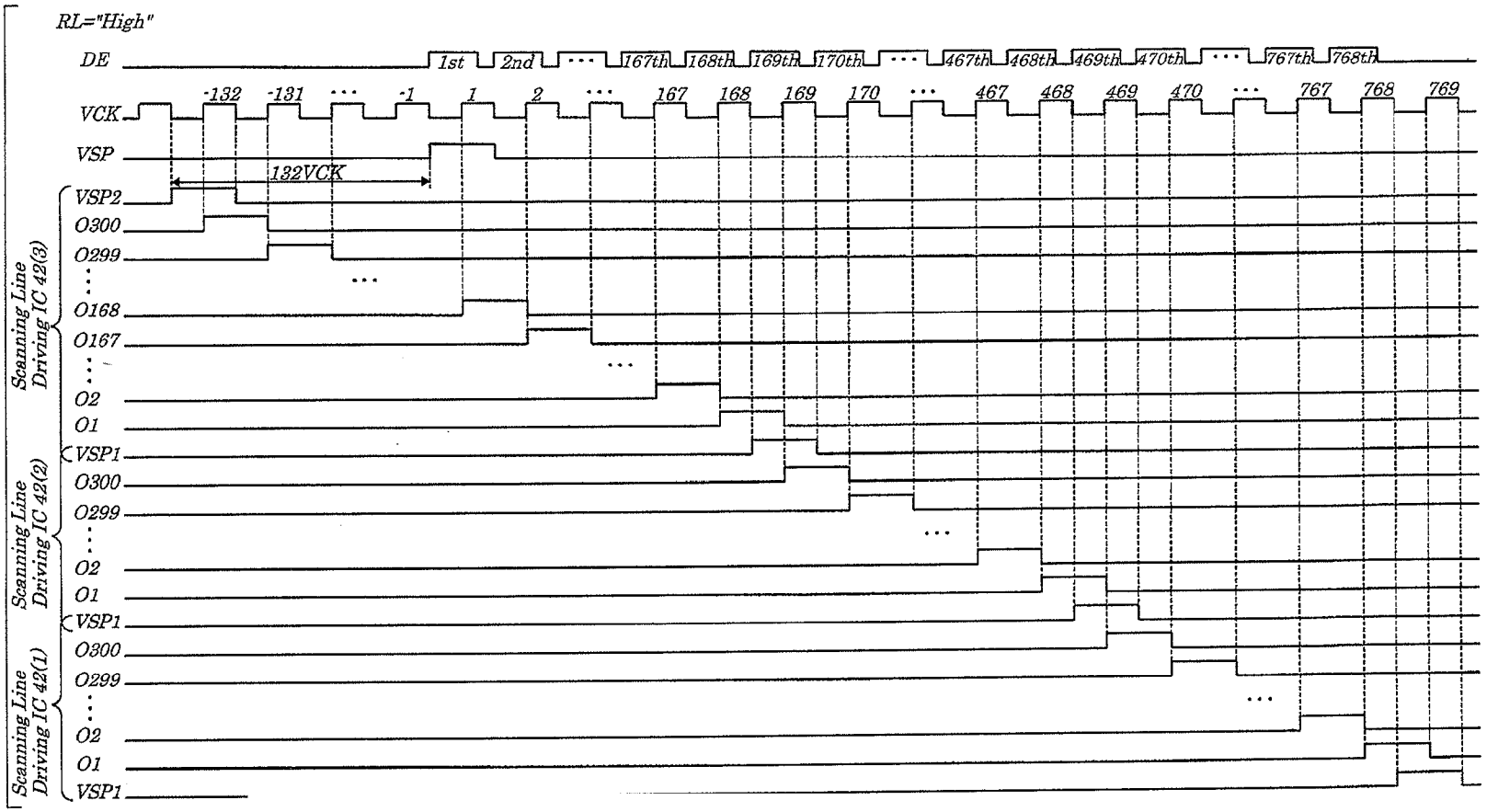
FIG. 6 is a timing chart explaining operations of a VSP generating section making up the timing controller for the image display device for the image display device according to the first exemplary embodiment.

FIG. 1 is a block diagram showing electrical configurations of a timing controller for an image display device of the first exemplary embodiment of the present invention. FIG. 2 is a block diagram showing electrical configurations of a liquid crystal display device using the timing controller for the image display device. FIG. 3 is a block diagram showing electrical configurations of a valid line counting section of the timing controller for the image display device. FIG. 4 is a timing chart showing internal signals of the timing controller for the image display device. FIG. 5 is a timing chart explaining operations of a cascade signal counting section making up the timing controller for the image display device. FIG. 6 is a timing chart explaining operations of a VSP generating section making up the timing controller for the image display device.

The timing controller 10 for the image display device of the exemplary embodiment is a device capable of performing a normal display at the time of reverse scanning in upward and downward directions irrespective of non-coincidence (discrepancy) between resolution (count of valid driving lines) of a liquid crystal display panel and the total count of outputs from a scanning line electrode driving circuit and, as is shown in FIG. 1, is diagrammatically and mainly made up of the valid line counting section 11, the cascade signal counting section 12, a calculating section 13, the VSP generating section 14, a video data processing section (not shown), and a timing generating section (not shown).

The valid line counting section 11 counts the count of valid driving lines based on a DE (Data Enable) signal and DCK signal supplied from the outside of an image display device. The cascade signal counting section 12 counts a cascade output signal (cascade vertical start pulse signal) VSP1 outputted from a scanning line driving IC 42 (see FIG. 2). The calculating section 13 calculates a difference between a value outputted from the valid line counting section 11 and a value outputted from the cascade signal counting section 12. The VSP generating section 14 automatically and newly generates a start pulse signal VSP2 (Vertical Start Pulse signal) based on calculated data outputted from the calculating section 13 and outputs the start pulse signal VSP2 with corresponding timing. The start pulse signal VSP2 is used as a start pulse signal for a frame subsequent to the frame during which the start pulse signal VSP2 was generated. The video data processing section processes image data supplied from the outside. The timing generating section, after receiving the DE signal, generates a VCK (Vertical Clock) signal for the scanning line driving IC and a VOE (Vertical Output Enable) signal for the scanning line driving IC, a POL (Polarity Inverting) signal for ac-drive of the liquid crystal display, and an HSP (Horizontal Start Pulse) signal and a DLP (Data Latch Pulse) signal for a signal line driving IC.

The valid line counting section 11 is configured as shown in FIG. 3. The valid line counting section 11 includes a horizontal side reference signal generating block 111, an HT counter (HTCO) 112, an Htotal register 113, a VALID generating block 114, a V counter (VCO) 115, and a V register 116. The horizontal side reference signal generating block 111, after receiving the DE signal supplied from the outside, generates an HS (Horizontal Signal). The HT counter (HTCO) 112, in response to the DE signal, counts the count of DCK signals outputted for a period from the present rise of the DE signal to the next rise of the DE signal. The Htotal register stores the counted value outputted from the HT counter 112.

The VALID generating block 114, after receiving a value outputted from the HT counter 112 and a value outputted from the Htotal register 113, based on both the values, outputs a "high" VALID signal or a "low" VALID signal. The V counter 115, at the time of the rise of the VALID signal, counts an HS signal outputted from the horizontal side reference signal generating block 111 and counts the count of valid driving lines. The V register 116 stores the count of valid driving lines counted by the V counter 115 at the time of the fall of the VALID signal.

The timing controller 10 for the image display device having such configurations as described above is used as one of component elements of the image display device 100 shown in FIG. 2. The image display device 100 diagrammatically includes the timing controller 10, a liquid crystal display panel 20, a signal line electrode driving circuit 30, and a scanning line electrode driving circuit 40.

The liquid crystal display panel 20 is made up of a plurality of scanning electrodes mounted on its substrate at a predetermined interval in a row direction, a plurality of signal line electrodes mounted on its substrate at a predetermined interval in a column direction, liquid crystal cells each being a equivalently capacitive load at the intersection for both the electrodes in a manner opposite to each other and being sandwiched therebetween, a common electrode, TFTs each to drive a corresponding liquid crystal cell, and capacitors each to store electric charges corresponding to data for one vertical synchronizing period.

The signal line electrode driving circuit 30 is made up of one or more HTCPs 31 each having a signal line driving IC 32 used to drive signal lines of the liquid crystal display panel 20 and having a plural-stage structure in which the signal line driving ICs 32 are serially connected thereto. Each of the signal line driving ICs captures image data with timing when each of the HSP, DLP, POL and DCK signals is outputted from the timing controller 10 for the image display device and has a function of converting an image into a corresponding voltage for every pixel of one line to apply the converted voltage to a corresponding pixel electrode of one line through a drain electrode of the TFT.

The scanning line electrode driving circuit 40 is made up of one or more VTCPs 41 each having the scanning line driving IC 42 to be used to drive scanning lines of the liquid crystal display panel 20 and having a plural-stage structure in which the scanning line driving ICs are serially connected thereto. The scanning line driving IC, in accordance with the VSP, VOE, and VCK signals, performs an operation to simultaneously control all the scanning line electrodes of the TFT for every line sequentially from above and brings each TFT on the line being now being controlled into conduction and applies a gray level voltage to be supplied to the signal line connected, at the time of conduction, from the signal line driving IC 32 to its output portion, to the pixel electrode of a corresponding liquid crystal cell.

Next, by referring to FIG. 1 to FIG. 6, operations in the exemplary embodiment are described. While the image display device 100 in which the timing controller 10 for the image display device is embedded is being described, operations of the timing controller 10 are also explained at the same time. In this description, one example case is used in which the image display device 100 has display resolution of XGA (1024×768) and three scanning line driving ICs 42 providing 300 outputs are cascade connected and image display is performed by reverse scanning in upward and downward directions (for example, from bottom to top).

In the operation of the image display device, the valid line counting section 11 of the timing controller 10 counts the count of valid driving lines based on the DE and DCK signals fed from the outside. The counting operation is described by referring to FIGS. 3 and 4. The DE signal is a timing signal to regulate a signal period of a line to be used for screen display for the liquid crystal display panel 20. The horizontal side reference signal generating block 111 to which the DE signal (see DE in FIG. 4) supplied from the outside is inputted generates an HS (Horizontal Signal) (see HS in FIG. 4). The HT counter (HTCO) 112, when the DE signal rises, performs reset and start-up operations to count the count of DCK signals occurring during a period of time from the rise of the DE signal to a subsequent rise of the DE signal (see HT counter in FIG. 4) and stores the counted value in the Htotal register 113 (see Htotal register in FIG. 4).

The VALID generating block 114 to receive a value of the HT counter 112 and a value of the Htotal register, when the value of the HT counter 112 is less than the value of "a value of the Htotal register 113+10", makes the VALID signal (VALID in FIG. 4) be "high" and, when the value of the HT counter 112 is not less than the value of "the value of the Htotal register 113+10", judges that no more valid driving lines exist and makes the VALID signal be "low". The period during which the VALID signal is "high" is a valid period for one frame. The V counter (VCO) 115, when the VALID signal rises, performs reset and start-up operations to count the HS signal (V counter in FIG. 4) and, when the VALID signal falls, stores the V counter value existing at the point of time in the V register 116 (V register in FIG. 4). Thus, the count of valid driving lines is measured. In the present embodiment, the count of valid driving lines is the value of "V register value+1" (767+1=768).

Next, operations of the cascade signal counting section 12 are described. The cascade signal counting section 12 counts the total signals including the VSP2 outputs generated by the timing controller 10 up to the VSP cascade outputting signal VSP1 from the scanning line driving IC4. FIG. 5 shows a timing chart of scanning line outputs and each VSP signal in the structural example of the exemplary embodiment in which three scanning line driving ICs are cascade connected. As is apparent from FIG. 5, the counted value VCK of the cascade signals in the example is 900.

Next, operations of the calculating section 13 are described. The calculating section 13 calculates an excessive output from a difference between the count of valid driving lines counted by the valid line counting section 11 and the total count of outputs from the scanning line driving ICs 42 calculated by the cascade signal counting section 12. In the exemplary embodiment, the count of valid driving lines is 768 lines and total count of outputs from the scanning line driving ICs 42 is 900 clocks. Therefore, the excessive output of the scanning line driving ICs is 132 outputs (900−768).

Next, operations of the VSP generating section 14 are described. The VSP generating section 14 generates the VSP2 signal at the time shifted, by the time corresponding to the excessive outputs from the scanning line driving ICs 42 calculated by the calculating section 13, from the reference VSP generating time which is the rising time of the VSP signal in FIG. 6, that is, the reference time of a start pulse signal. In the above embodiment, as shown in FIG. 6, the VSP2 signal is generated earlier, by the time corresponding to the 132 VCK signals, then the reference VSP signal is generated.

Figure 14:
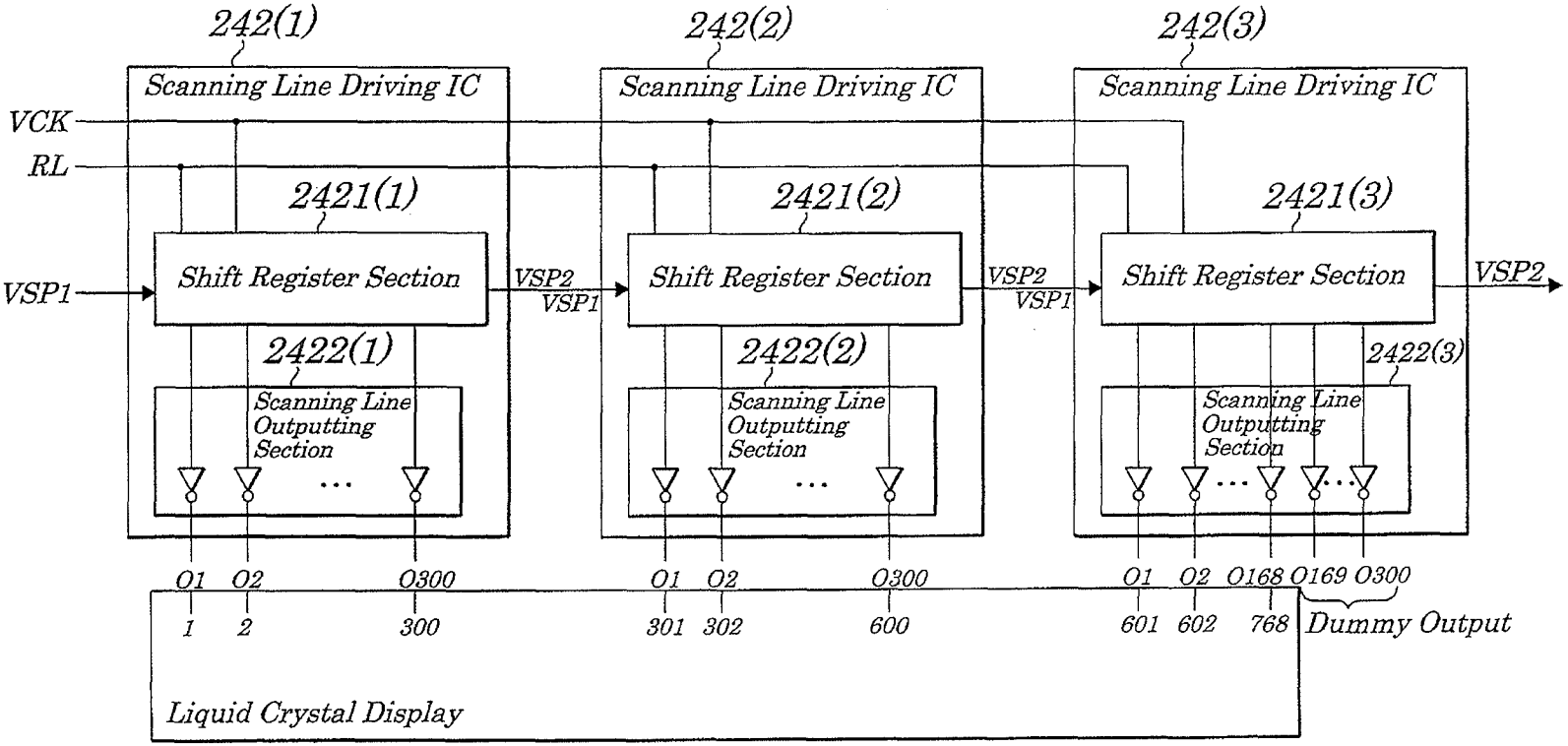
FIG. 14 (RELATED ART)
FIG. 14 is a block diagram showing electrical configurations of another type of a scanning line electrode driving circuit to be used in the related liquid crystal display device.

Thus, by generating the VSP signal used to drive the liquid crystal display panel 20, normal display can be achieved, that is, even if there are outputs, out of the outputs from the scanning line driving ICs 42 being cascade connected, being not connected to the scanning line electrode of the liquid crystal display panel 20, which are, in the above embodiment, the 132 excessive outputs (see FIG. 14) between the output 0169 to 0300, thereafter by using, sequentially, output signals from the scanning line driving ICs 42 connected to the scanning line electrode of the liquid crystal display panel 20, the reverse scanning operations can be performed on the valid 768 lines without causing any problem, display on the liquid crystal display panel is made normal.

Moreover, even in the case of employing the above configuration, the scanning line driving at the time of sequential scanning is performed as a sequential scanning (for example, scanning from top to bottom), that is, as the line sequential driving by outputs from the scanning line driving ICs 42 connected to the scanning electrode of the liquid crystal display panel 20 and, therefore, the driving is not affected by the excessive outputs from the scanning line driving ICs 42 described above and the VSP1 signal is fixed with the same timing as the reference VSP signal and outputs remain to be ordinary outputs. Thus, display on the liquid crystal display panel 20 can be achieved normally. As described above, in the timing controller 10, the count of lines displayed on the liquid crystal display panel 20 is counted and the total count of outputs from the scanning line driving ICs 42 is counted, the difference between both the counted values is calculated to automatically generate the VSP signal and the scanning line driving IC is driven by the VSP signal and, therefore, display can be performed normally not only at the time of sequential scanning in upward and downward directions but also at the time of reverse scanning in the upward and downward directions.

Thus, according to the present embodiment, a mechanism is employed in which the VSP signal is automatically (autonomously) generated based on the count of lines displayed on the liquid crystal display panel and the total count of outputs from the scanning line driving IC to be used for driving the liquid crystal display panel and, therefore, even by combining a liquid crystal panel having arbitrary resolution with arbitrary pieces of the scanning line driving ICs having arbitrary count of outputs, any change in setting for the timing controller is not required and the arbitrary combinations are freely (autonomously) allowed to be selected, thereby enabling normal display at a time of reverse scanning in upward and downward directions. Owing to the effect by the above configurations, among the liquid crystal panels each having different resolution, shared use of materials for the scanning line driving IC is made possible, thus enabling the reduction of costs and the supply of low-priced products. Further, the above combinations can be selected arbitrarily and freely and, therefore, even in the case where the liquid crystal display device has a variety of kinds of resolutions, the liquid crystal display device is allowed to be installed with a high degree of freedom.

Second Exemplary Embodiment

Figure 7:
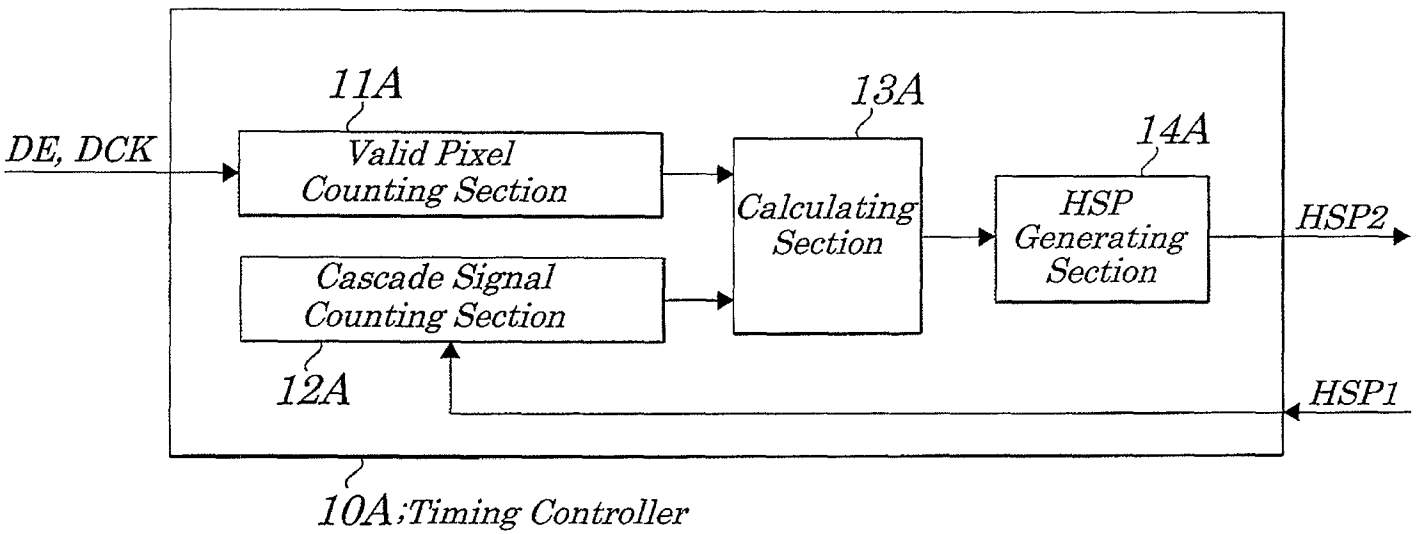
FIG. 7 is a block diagram showing electrical configurations of a timing controller for an image display device according to a second exemplary embodiment of the present invention.
Figure 8:
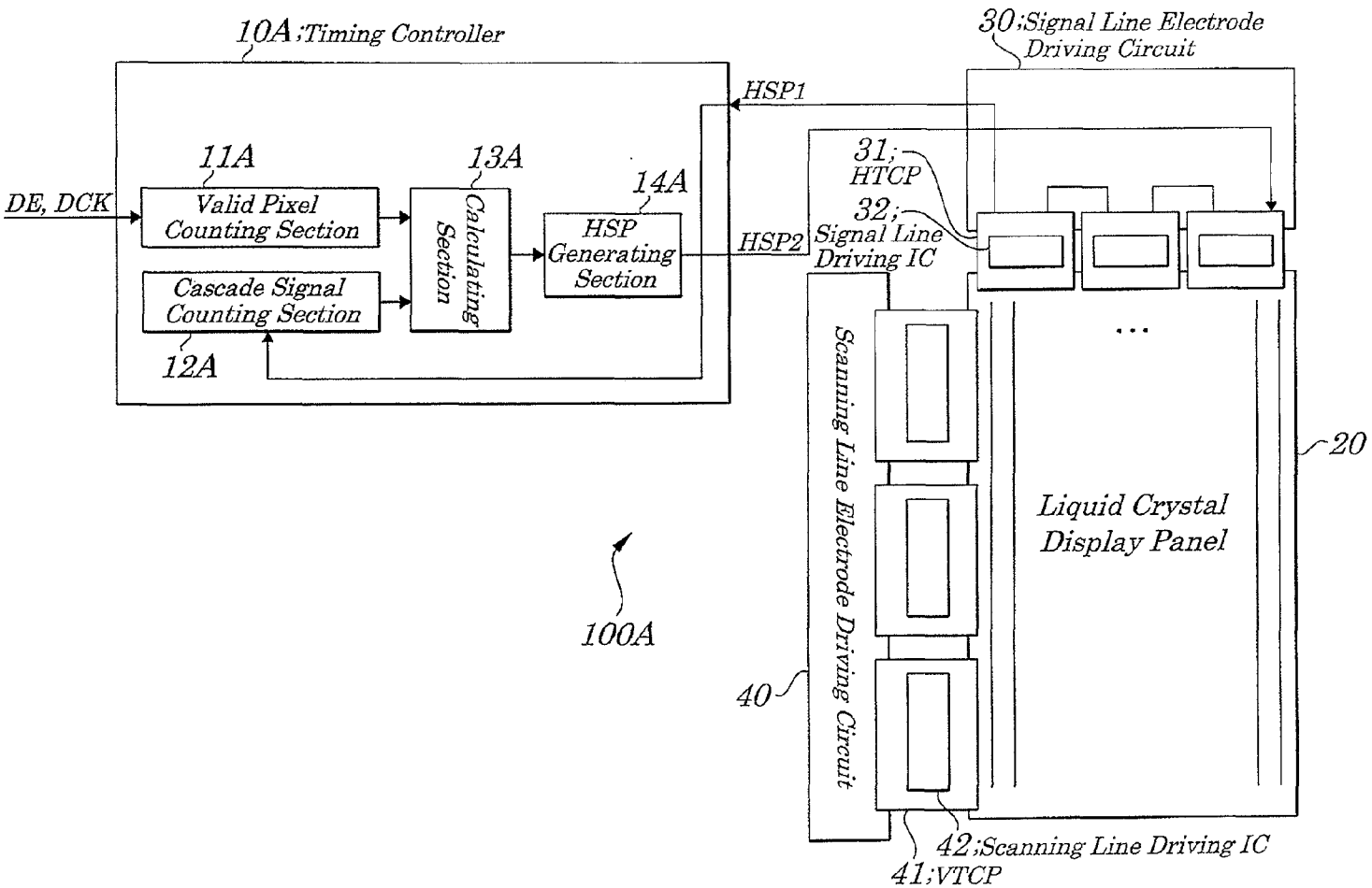
FIG. 8 is a block diagram showing electrical configurations of a liquid crystal display device using the timing controller for the image display device according to the second exemplary embodiment.
Figure 9:
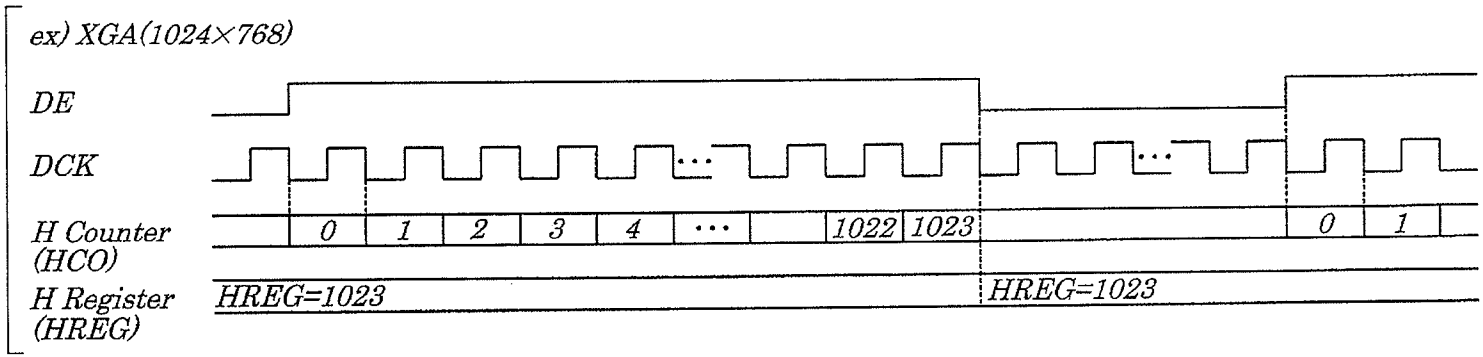
FIG. 9 is a block diagram showing electrical configurations of a valid pixel counting section of the timing controller for the image display device according to the second exemplary embodiment.
Figure 10:
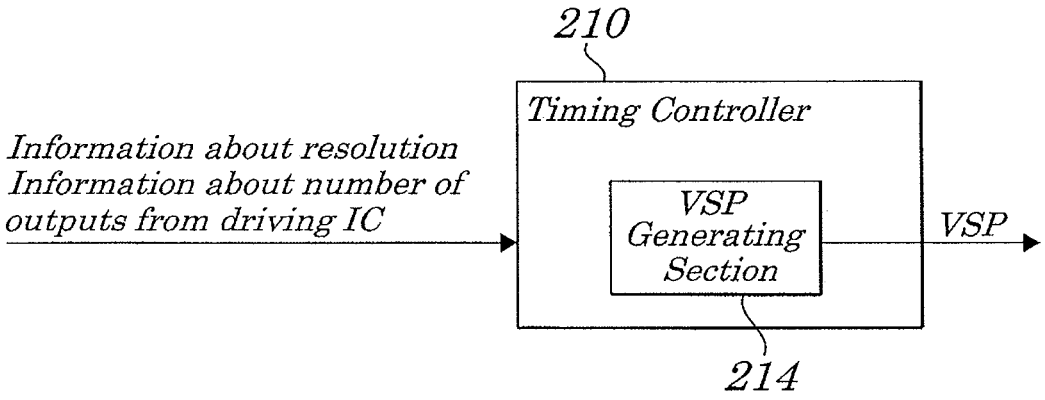
FIG.10 (RELATED ART)
FIG. 10 is a block diagram showing electrical configurations of a related timing controller for an image display device.
Figure 11:
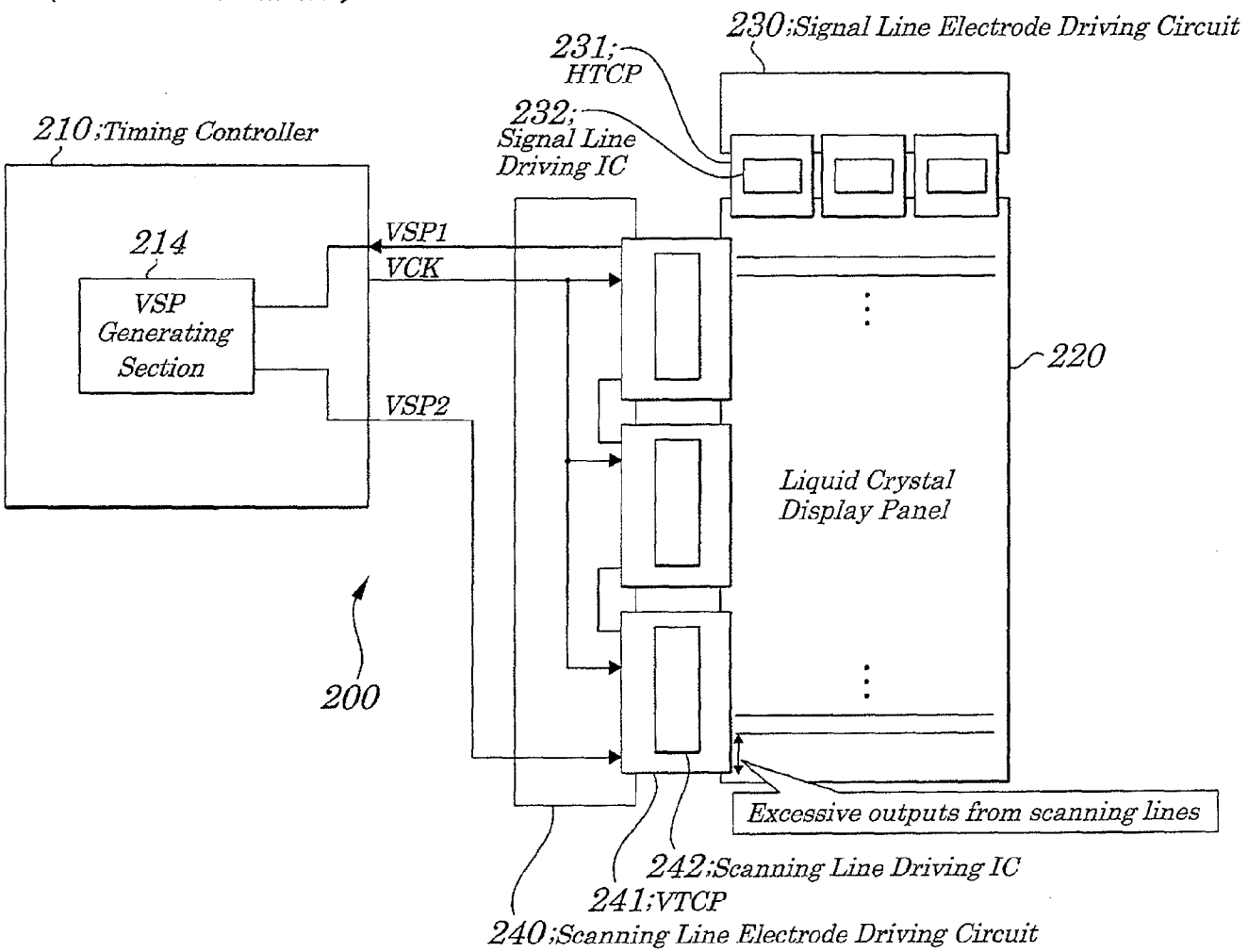
FIG.11 (RELATED ART)
FIG. 11 is a block diagram showing electrical configurations of a related liquid crystal display device.
Figure 12:
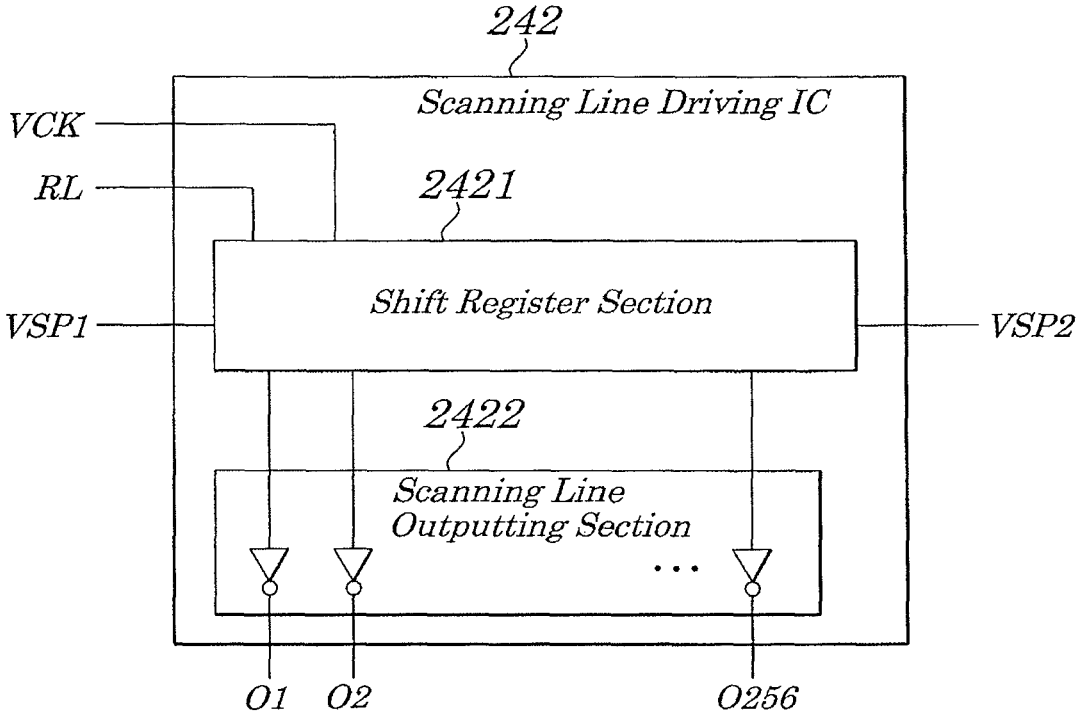
FIG. 12 (RELATED ART)
FIG. 12 is a block diagram showing electrical configurations of a scanning line driving IC to be used in the related liquid crystal display device.
Figure 13:
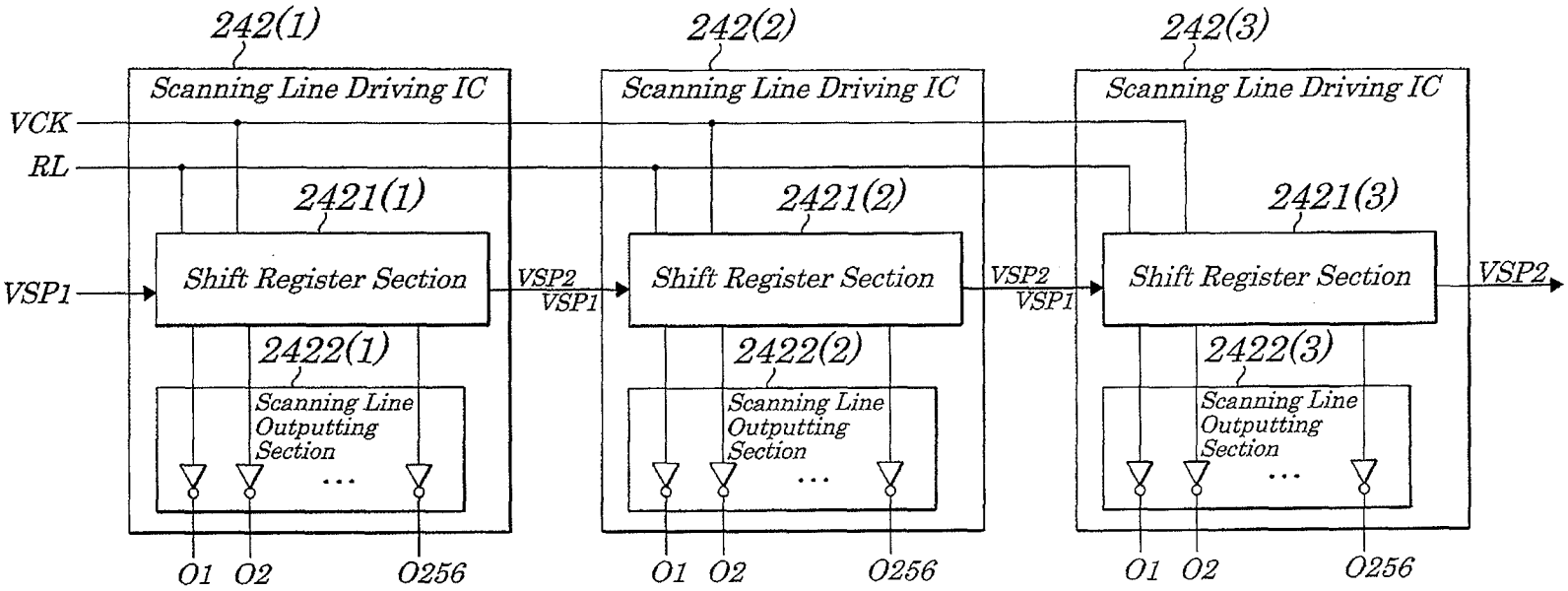
FIG.13 (RELATED ART)
FIG. 13 is a block diagram showing electrical configurations of one type of a scanning line electrode driving circuit to be used in the related liquid crystal display device.

FIG. 7 is a block diagram showing electrical configurations of a timing controller for an image display device of the second exemplary embodiment of the present invention. FIG. 8 is a block diagram showing electrical configurations of a liquid crystal display device using the timing controller for the image display device of FIG. 7. FIG. 9 is a block diagram showing electrical configurations of a valid line counting section of the timing controller for the image display device of FIG. 7. The configurations of the timing controller of the second exemplary embodiment differs greatly from that of the first exemplary embodiment in that the timing controller can perform normal display at the time of reverse scanning in upward and downward directions irrespective of non-coincidence (discrepancy) between a valid pixel count of a liquid crystal display panel and the total count of outputs from a signal line electrode driving circuit.

The timing controller of the second exemplary embodiment, as shown in FIG. 7, is diagrammatically made up of the valid pixel counting section 11A, the cascade signal counting section 12A, a calculating section 13A, the HSP generating section 14A, a video data processing section (not shown), and a timing generating section (not shown).

The valid pixel counting section 11A counts the count of valid pixels based on DE and DCK signals supplied from the outside. The cascade signal counting section 12A counts a cascade outputting signal (cascade horizontal start pulse signal) HSP1 to be outputted from a signal line driving IC 32 (see FIG. 8). The calculating section 13A calculates a difference between a value outputted from the valid pixel counting section 11A and a value outputted from the cascade signal counting section 12A. The HSP generating section 14A automatically and newly generates a start pulse signal HSP2 based on calculated data outputted from the calculating section 13A and outputs the start pulse signal HSP2 with corresponding timing.

The video data processing section processes image data supplied from the outside. The timing generating section, after receiving the DE signal, generates a DLP signal for the signal line driving IC, VSP signal for the scanning line driving IC, VCK signal, VOE signal, and polarity inverting signal (POL) for ac drive of the liquid crystal display.

The timing controller 10A for the image display device having such configurations as described above is used as one of component elements of the image display device 100 shown in FIG. 2. The image display device 100A diagrammatically includes the timing controller 10A, a liquid crystal display panel 20, a signal line electrode driving circuit 30, and a scanning line electrode driving circuit 40.

The liquid crystal display device 20 is made up of a plurality of scanning electrodes mounted on its substrate at a predetermined interval in a row direction, a plurality of signal line electrodes mounted on its substrate at a predetermined interval in a column direction, a liquid crystal cell being a equivalently capacitive load at the intersection for both the electrodes in a manner opposite and being sandwiched, a common electrode, a TFT to drive a corresponding liquid crystal cell, and a capacitor to store electric charges corresponding to data for one vertical synchronizing period.

The signal line electrode driving circuit 30 is made up of one or more HTCPs 31 each having a signal line driving IC 32 used to drive signal lines of the liquid crystal display panel 20. The scanning line electrode driving circuit 40 is made up of one or more VTCPs 41 each having a scanning line driving IC 42 to be used to drive scanning lines of the liquid crystal display panel 20.

Next, by referring to FIG. 7 to FIG. 9, operations in the exemplary embodiment are described. While the image display device 100A in which the timing controller 10A for the image display device is embedded is being described, operations of the timing controller 10A are also explained at the same time. In this description, one example case is used in which the image display device 100A has display resolution of XGA (1024×768) and seven signal line driving ICs 32 providing 480 outputs are cascade connected and image display is performed by reverse scanning in right and left directions.

In the operation of image display, the valid pixel counting section 11A of the timing controller 10A counts the count of valid pixels in one line based on the DE and DCK signals fed from the outside. The counting operation is described in detail by referring to FIG. 9. The valid pixel counting section 11A has an H counter (HCO) and H register (HREG) and the H counter (HCO), as described below, counts the count of valid pixels in one line. The H counter (HCO), when the DE signal rises (see DE in FIG. 9), performs reset and start-up operations to count the count of DCK signals (see DCK in FIG. 9) occurring during a period of time from the rise of the DE signal to a fall of the DE signal (see HCO in FIG. 9) and stores the counted value in the H register (see HREG in FIG. 9). Thus, the count of valid pixels is counted. The count of valid pixels in the exemplary embodiment is, as shown in FIG. 9, "H register value+1" (1023+1=1024) pixels.

Next, operations of the cascade signal counting section 12A are described. Operations of the cascade signal counting section 12A are the same as those of the first exemplary embodiment except that the count of the VCK, instead of the count of the DCK, are counted. The cascade signal counting section 12A counts the total count of DCK signals including the HSP2 output signals generated by the timing controller 10A up to the HSP cascade output signal HSP1. In the exemplary embodiment, seven pieces of the signal line driving IC 32 are cascade connected and the cascade signal counted number is 1120 DCK.

Next, operations of the calculating section 13A are described. In the operations of the calculating section 13A of the second exemplary embodiment, the difference between the count of valid pixels and the total count of outputs from the signal line driving IC 32 is calculated unlike in the case of the first exemplary embodiment in which the difference between the count of valid driving lines and the total count of outputs from the scanning line driving IC 42 and other operations are the same as those in the first exemplary embodiment. That is, excessive outputs from the signal line driving IC 32 are calculated from the difference between the count of valid pixels counted by the valid pixel counting section 11A and the DCK number (total numbers of outputs) of the signal line driving IC 32 counted by the cascade signal counting section 12A. In the exemplary embodiment, the count of valid pixels is 1024 and the count of DCKs of the signal line driving IC 32 is 1120. Therefore, excessive output of the signal line driving IC 32 is 96 (1120−1024=96 outputs).

Next, operations of the HSP generating section 14Aa are described. The HSP generating section 14A has a function of outputting the HSP2 signal in a manner time-shifted by the timing corresponding to the excessive outputs of the VSP2 signal, instead of the function of outputting the VSP2 signal in a manner time-shifted by the timing corresponding to the excessive outputs of the scanning line driving IC 42. The operations other than above are substantially the same as those in the first exemplary embodiment. That is, the HSP2 signal is outputted in a manner shifted from the reference HSP generating time which is the rise time of the HSP signal and reference time for a start pulse signal by the timing corresponding to the excessive outputs of the signal line driving IC 32 calculated by the calculating section 13A. In the above embodiment, the HSP2 signal is generated earlier, by the time corresponding to the 96 VCKs, then the reference HSP signal is generated.

As described above, by performing a dummy drive in which the HSP signal is generated in a manner time-shifted by the count of DCK signals, which are the excessive outputs from the signal line driving IC 32 being not connected to the signal line electrode in the liquid crystal display panel 20 and by sequentially shifting the outputs, which follow the excessive outputs, from the signal line driving IC being connected to the signal line electrode in the liquid crystal display panel 20, the reverse scanning on valid 1024 pixels can be performed without causing any problems. Therefore, a screen can be normally displayed on the liquid crystal display panel 20. At the time of sequential scanning (scanning from one side to another side), the outputs from the signal line driving IC being connected to the signal line electrode in the liquid crystal display panel 20 are shifted sequentially in an ordinary order and are not affected by the excessive outputs and, therefore, the HSP1 signal is fixed with the same timing as the reference HSP being in advance set in the liquid crystal display panel 20 and is treated as an ordinary output.

Thus, in the second exemplary embodiment, the essence of the invention is the same as for the first exemplary embodiment and, as a result, the same effect as obtained in the first exemplary embodiment can be achieved. That is, the mechanism is employed in which the HSP signal is automatically generated based on a difference between the count of valid pixels of the liquid crystal display panel mounted on the liquid crystal display device and the total count of outputs from the signal line driving IC to be used for the driving of the liquid crystal display panel and, therefore, even when the liquid crystal display panel having arbitrary resolution is combined with arbitrary pieces of the signal line driving IC providing arbitrary count of outputs, the above arbitrary combination can be freely achieved without any change of the setting of the timing controller and normal display can be realized at the reverse scanning in right and left directions (scanning from the other side to the one side).

Further, the shared use of materials for the signal line driving IC among the liquid crystal display panels each having different resolution is made possible and the above arbitrary combinations can be freely realized and, therefore, even if the liquid crystal display devices having a variety of resolutions is to be used, the various liquid crystal display devices can be installed with high freedom, which enables the reduction of costs of the timing controller and supply of low-priced products.

While the invention has been particularly shown and described with reference to exemplary embodiments thereof, the invention is not limited to these exemplary embodiments. For example, in the configurations in which the start pulse signal can be generated not only autonomously but also semi-automatically and, within the limit, what is intended by the invention can be achieved. For example, when the count of valid driving lines can be known in advance in an arbitrary manner, by informing the value to the timing controller from the outside via an arbitrary means, the present invention can be implemented. Moreover, instead of using the VSK numbers from the VSP2 to VSP1 as the total count of outputs from the scanning line driving IC or the like, by calculating the total count of outputs during a frame a specified number before, the calculated number may be used in a present frame. It is needless to say that the timing controller described in the above embodiments may be used in the scanning line driving IC or the signal line driving IC having any count of outputs so long as the driving IC has resolution of WXGA (Wide eXtended Graphic Array: 1366×800) with one port input and one port output.

It is also needless to say that the timing controller described in the above embodiments can be used in any case where the interfacing with the signal line driving IC is of a type of CMOS (Complementary Metal-Oxide Semiconductor) method or of a type of RSDS (Reduction Swing Differential Signaling) method. Furthermore, the timing controller described in the above embodiments may be used without any problem even if the excessive outputs occur both from the signal line driving IC and from the scanning line driving IC.

The timing controller, the timing signal generating method, and the image display device and the image display control method using the same can be applied not only to an arbitrary liquid crystal display device but also other types of liquid crystal display device.

What is claimed is:

1. A timing controller to be used for displaying a reverse video image comprising:

a difference measuring unit to measure, based on a timing signal to be supplied from an outside for every predetermined period to regulate driving of a display panel, a vertical start pulse signal to be outputted when a scanning line driving circuit, which has a cascaded shift register configuration, drives said display panel, and a cascade output signal being outputted from said scanning line driving circuit when a specified period of time has elapsed after said vertical start pulse signal has been fed to said scanning line driving circuit, a difference "M−L" between a count "L" of valid driving lines of said display panel and a total count "M" (M>L) of outputs from said scanning line driving circuit; and a signal outputting unit to output a vertical start pulse signal in reverse scanning from bottom to top on said display panel with timing shifted from a reference time for a vertical start pulse signal in sequential scanning from top to bottom on said display panel, the shifted timing being determined based on said difference measured by said difference measuring unit, first to L-th outputs from said scanning line driving circuit are connected to said valid driving lines of said display panel, counting from a start side of said sequential scanning, whereas L+1-th to M-th outputs from said scanning line driving circuit are excessive outputs which are not connected to said valid driving lines of said display panel, wherein said difference measuring unit comprises:

a valid line counting unit to count said count "L" of said valid driving lines for an image to be displayed on said display panel based on said timing signal;

a cascade signal counting unit to count said total count "M" of outputs from said scanning line driving circuit based on said cascade output signal to be outputted from said scanning line driving circuit at a time of said reverse scanning from the bottom to the top and on said vertical start pulse signal to be supplied to said scanning line driving circuit at the time of said reverse scanning from the bottom to the top; and a calculating unit to calculate said difference "M−L" between said count "L" of valid driving lines outputted from said valid line counting unit and said total count "M" of outputs outputted from said cascade signal counting unit and determine a count of excessive outputs from said canning line driving circuit, based on the calculated difference.

2. The timing controller according to claim 1, wherein said timing signal comprises a data enable signal and a clock signal for said scanning line driving circuit.

3. The timing controller according to claim 1, wherein said scanning line driving circuit sequentially outputs scanning line driving signals from the top to the bottom at a time of said sequential scanning, when receiving said vertical start pulse signal for said sequential scanning from said signal outputting unit, whereas said scanning line driving circuit sequentially outputs scanning line driving signals from the bottom to the top at a time of said reverse scanning, when receiving said vertical start pulse signal for said reverse scanning from said signal outputting unit.

4. A timing controller to be used for displaying a reverse video image comprising:

a difference measuring unit to measure, based on a timing signal to be supplied from an outside for every predetermined period to regulate driving of a display panel and a horizontal start pulse signal to be outputted when a signal line driving circuit, which has a cascaded shift register configuration, drives said display panel, and a cascade output signal being outputted from said signal line driving circuit when a specified period of time has elapsed after said vertical start pulse signal has been fed to said signal line driving circuit, a difference "M−L" between a count "L" of valid pixels in one line forming an image to be displayed on said display panel and a total count "M" (M>L) of outputs from said signal line driving circuit; and a signal outputting unit to output a horizontal start pulse signal in reverse scanning from one side to another side on said display panel with timing shifted from a reference time for a horizontal start pulse single in sequential scanning from the other side to the one side on said display panel, the shifted timing being determined based on said difference measured by said difference measuring unit, first to L-th outputs from said signal line driving circuit are connected to said valid pixels of said display panel, counting from a start side of sequential scanning, whereas L+1-th to M-th outputs from said signal line driving circuit are excessive outputs which are not connected to said valid pixels of said display panel, wherein said difference measuring unit comprises:

a valid pixel counting unit to count said count "L" of said valid pixels in one line based on said timing signal;

a cascade signal counting unit to count said total count "M" of outputs from said signal line driving circuit based on said cascade output signal to be outputted from said signal line driving circuit at a time of said reverse scanning from the one to the other and on said start pulse signal to be supplied to said signal line driving circuit at the time of said reverse scanning from the one to the other; and a calculating unit to calculate said difference "M−L" between said count "L" of valid pixels outputted from said valid pixel counting unit and said total count "M" of outputs outputted from said cascade signal counting unit and determine a count of excessive outputs from said signal line driving circuit, based on the calculated difference.

5. The timing controller according to claim 4, wherein said timing signal comprises a data enable signal and a clock signal for a signal line driving circuit.

6. The timing controller according to claim 4, wherein said signal line driving circuit sequentially outputs signal line driving signals from the other side to the one side at a time of said sequential scanning, when receiving said horizontal start pulse signal for said sequential scanning from said signal outputting unit, whereas said signal line driving circuit sequentially outputs signal line driving signals from the one r side to the other side at a time of said reverse scanning, when receiving said horizontal start pulse signal for said reverse scanning from said signal outputting unit.

7. A timing signal generating method to be used for displaying a reverse video image, comprising:

a process of measuring, based on a timing signal to be supplied from an outside for every predetermined period to regulate driving of a display panel, a vertical start pulse signal to be outputted when a scanning line driving circuit, which has a cascaded shift register configuration, drives said display panel, and a cascade output signal being outputted from said scanning line driving circuit when a specified period of time has elapsed after said vertical start puke signal has been fed to said scanning line driving circuit, a difference "M−L" between a count "L" of valid driving lines of said display panel and a total count "M" (M>L) of outputs from said scanning line driving circuit; and a process of outputting a vertical start pulse signal in reverse scanning from bottom to top on said display panel with timing shifted from a reference time for a vertical start pulse signal in sequential scanning, the shifted timing being determined based on the measured difference, first to L-th outputs from said scanning line driving circuit are connected to said valid driving lines of said display panel, counting from a start side of said sequential scanning, whereas L+1-th to M-th outputs from said scanning line driving circuit are excessive outputs which are not connected to said valid driving lines of said display panel, wherein the process of measuring comprises:

counting said count "L" of said valid driving lines for an image to be displayed on said display panel based on said timing signal;

counting said total count of "M" outputs from said scanning line driving circuit based on a cascade output signal to be outputted from said scanning line driving circuit at a time of said reverse scanning from the bottom to the top and on said vertical start pulse signal to be supplied to said canning line driving circuit at the time of said reverse scanning from the bottom to the top;

calculating said difference "M−L" between said count "L" of valid driving lines and said total count "M" of outputs and;

determining a count of excessive outputs from said scanning line driving circuit, based on the calculated difference.

8. The timing signal generating method according to claim 7, wherein said timing signal comprises a data enable signal and a clock signal for said scanning line driving circuit.

9. The timing signal generating method according to claim 7, wherein said scanning line driving circuit sequentially outputs scanning line driving signals from the top to the bottom at a time of said sequential scanning, when receiving said vertical start pulse signal for said sequential scanning, whereas said scanning line driving circuit sequentially outputs scanning line driving signals from the bottom to the top at a time of said reverse scanning, when receiving said vertical start pulse signal for said reverse scanning.

10. A timing signal generating method to be used for displaying a reverse video image, comprising:

a process of measuring, based on a timing signal to be supplied from an outside for every predetermined period to regulate driving of a display panel, a horizontal start pulse signal to be outputted when a signal line driving circuit, which has a cascaded shift register configuration, drives said display panel, and a cascade output signal being outputted from said signal line driving circuit when a specified period of time has elapsed after said vertical start pulse signal has been fed to said line driving circuit, a difference "M−L" between a count "L" of valid pixels in one line forming an image to be displayed on said display panel and a total count "M" (M>L) of outputs from said signal line driving circuit; and a process of outputting a horizontal start pulse signal in reverse scanning from one side to another side on said display panel with timing shifted from a reference time for a horizontal start pulse signal in sequential scanning from the other side to the one side on said display panel, the shifted timing being determined based on the measured difference, first to L-th outputs from said signal line driving circuit are connected to said valid pixels of said display panel, counting from a start side of said sequential scanning, whereas L+1-th to M-th outputs from said signal line driving circuit are excessive outputs which are not connected to said valid pixels of said display panel, wherein the process of measuring comprises:

counting said count "L" of said valid pixels in one line based on said timing signal;

counting said total count "M" of outputs from said signal line driving circuit based on said cascade output signal to be outputted from said signal line driving circuit at a time of said reverse scanning from the one to the other and on said horizontal start pulse signal to be supplied to said signal line driving circuit at the time of said reverse scanning from the one to the other;

calculating said difference "M−L" between said count "L" of valid pixels and said total count "M" of outputs; and determining a count of excessive outputs from said signal line driving circuit, based on the calculated difference.

11. The timing signal generating method according to claim 10, wherein said timing signal comprises a data enable signal and a clock signal for a signal line driving circuit.

12. The timing signal generating method according to claim 10, wherein said signal line driving circuit sequentially outputs signal line driving signals from the other side to the one side at a time of said sequential scanning, when receiving said horizontal start pulse signal for said sequential scanning, whereas said signal line driving circuit sequentially outputs signal line driving signals from the one side to the other side at a time of said reverse scanning, when receiving said horizontal start pulse signal for said reverse scanning.

13. An image display device having a timing controller to be used for displaying a reverse video image, the timing controller comprising:

a difference measuring unit to measure, based on a timing signal to be supplied from an outside for every predetermined period to regulate driving of a display panel, a vertical start pulse signal to be outputted when a scanning line driving circuit, which has a cascaded shift register configuration, drives said display panel, and a cascade output signal being outputted from said scanning line driving circuit when a specified period of time has elapsed after said vertical start pulse signal has been fed to said scanning line driving circuit, a difference "M−L" between a count "L" of valid driving lines of said display panel and a total count "M" (M>L) of outputs from said scanning line driving circuit; and a signal outputting unit to output a vertical start pulse signal in reverse scanning from bottom to top on said display panel with timing shifted from a reference time for a vertical start pulse signal in sequential scanning from top to bottom on said display panel, the shifted timing being determined based on said difference measured by said difference measuring unit, first to L-th outputs from said scanning line driving circuit are connected to said valid driving lines of said display panel, counting from a start side of said sequential scanning, whereas L+1-th to M-th outputs from said scanning line driving circuit are excessive outputs which are not connected to said valid driving lines of said display panel, wherein said difference measuring unit comprising:

a valid line counting unit to count said count "L" of said valid driving lines for an image to be displayed on said display panel based on said timing signal;

a cascade signal counting unit to count said total count "M" of outputs from said scanning line driving circuit based on said cascade output signal to be outputted from said scanning line driving circuit at a time of said reverse scanning from the bottom to the top and on said vertical start pulse signal to be supplied to said scanning line driving circuit at the time of said reverse scanning from the bottom to the top; and a calculating unit to calculate said difference "M−L" between said count "L" of valid driving lines outputted from said valid line counting unit and said total count "M" of outputs outputted from said cascade signal counting unit and determine a count of excessive outputs from said scanning line driving circuit, based on the calculated difference.

14. An image display device having a timing controller to be used for displaying a reverse video image, the timing controller comprising:

a difference measuring unit to measure, based on a timing signal to be supplied from an outside for every predetermined period to regulate driving of a display panel and a horizontal start pulse signal to be outputted when a signal line driving circuit, which has a cascaded shift register configuration, drives said display panel and a cascade output signal being outputted from said signal line driving circuit when a specified period of time has elapsed after said vertical start pulse signal has been fed to said line driving circuit, a difference "M−l" between a count "L" of valid pixels in one line forming an image to be displayed on display panel and a total count "M" (M>L) of outputs from said signal line driving circuit; and a signal outputting unit to output a horizontal start pulse signal in reverse scanning from one side to another side on said display panel with timing shifted from a reference time for a horizontal start pulse signal in sequential scanning from the other side to the one side on said display panel, the shifted timing being determined based on said difference measured by said difference measuring unit, first to L-th outputs from said signal line driving circuit are connected to said valid pixels of said display panel, counting from start side of said sequential scanning, whereas L+1-th to M-th outputs from said signal line driving circuit are excessive outputs which are not connected to said valid pixels of said display panel, wherein said difference measuring unit comprising:

a valid pixel counting unit to count said count "L" of said valid pixels in one line based on said timing signal;

a cascade signal counting unit to count said total count "M" of outputs from said signal line driving circuit based on said cascade output signal to be outputted from said signal line driving circuit at a time of said reverse scanning from the one to the other and on said horizontal start pulse signal to be supplied to said signal line driving circuit at the time of said reverse scanning from the one to the other; and a calculating unit to calculate said difference "M−L" between said count "L" of valid pixels outputted from said valid pixel counting unit and said total count "M" of outputs outputted from said cascade signal counting unit and determine a count of excessive outputs from said signal line driving circuit, based on the calculated difference.

15. An image display control method for displaying a reverse video image, using a timing signal generating method comprising:

a process of measuring, based on a timing signal to be supplied from an outside for every predetermined period to regulate driving of a display panel, a vertical start pulse signal to be outputted when a scanning line driving circuit, which has a cascaded shift register configuration, drives said display panel, and a cascade output signal being outputted from said scanning line driving circuit when a specified period of time has elapsed after said vertical start pulse signal has been fed to said scanning line driving circuit, a difference "M−L" between a count "L" of valid driving lines of said display panel and a total count "M" (M>L) of outputs from said scanning line driving circuit; and a process of outputting a vertical start pulse signal in reverse scanning from bottom to top on said display panel with timing shifted from a reference time for a vertical start pulse signal in sequential scanning from top to bottom on said display panel, the shifted timing being determined based on the measured difference, first to L-th outputs from said scanning line driving circuit are connected to said valid driving lines of said display panel, counting from a start side of said sequential scanning, whereas L+1-th to M-th outputs from said scanning line driving circuit are excessive outputs which are not connected to said valid driving lines of said display panel, wherein the process of measuring comprises:

counting said count "L" of said valid driving lines for an image to be displayed on said display panel based on said timing signal;

counting said total count "M" of outputs from the scanning line driving circuit based on a said cascade output signal to be outputted from said scanning line driving circuit at a time of said reverse scanning from the bottom to the top and on said vertical start pulse signal to be supplied to said scanning line driving circuit at the time of said reverse scanning from the bottom to the top;

calculating said difference "M−L" between said count "L" of valid driving lines and said total count "M" of outputs and determining a count of excessive outputs from said scanning line driving circuit, based on the calculated difference.

16. An image display control method for displaying a reverse video image, using a timing signal generating method:

a process of measuring, based on a timing signal to be supplied from an outside for every predetermined period to regulate driving of a display panel, a horizontal start pulse signal to be outputted when a signal line driving circuit, which has a cascaded shift register configuration, drives said display panel, and a cascade output signal being outputted from said signal line driving circuit when a specified period of time has elapsed after said vertical start pulse signal has been fed to said signal line driving circuit, a difference "M−L" between a count "L" of valid pixels in one line forming an image to be displayed on of said display panel and a total count "M" (M>L) of outputs from said signal line driving circuit; and a process of outputting a horizontal start pulse signal in reverse scanning from one side to another side on said display panel with timing shifted from a reference time for a horizontal start pulse signal in sequential scanning from the other side to the one side on said display panel, the shifted timing being determined based on the measured difference, first to L-th outputs from said signal line driving circuit are connected to said valid pixels of said display panel, counting from a start side of said sequential scanning, whereas L+1-th to M-th outputs from said signal line driving circuit are excessive outputs which are not connected to said valid pixels of said display panel, wherein the process of measuring comprises:

counting said count "L" of said valid pixels in one line based on said timing signal;

counting said total count "M" of outputs from said signal line driving circuit based on said cascade output signal to be outputted from said signal line driving circuit at a time of said reverse scanning from the one to the other and on said horizontal start pulse signal to be supplied to said signal line driving circuit at the time of said reverse scanning from the one to the other;

calculating said difference "M−L" between said count "L" of valid pixels and said total count "M" of outputs; and determining a count of excessive outputs from said signal line driving circuit, based on the calculated difference.

* * * * *